United States Patent [19]

Neary et al.

[11] Patent Number: 4,470,279

[45] Date of Patent: Sep. 11, 1984

[54] LOCKSET FOR A DOOR PANEL

[75] Inventors: Ralph E. Neary, San Francisco; Leon F. Tatara, Newark, both of Calif.

[73] Assignee: Schlage Lock Company, San Francisco, Calif.

[21] Appl. No.: 375,722

[22] Filed: May 7, 1982

[51] Int. Cl.[3] ..... E05C 1/16

[52] U.S. Cl. ..... 70/134; 292/169.14; 292/359

[58] Field of Search ..... 292/169.16, 169.18, 292/359; 70/421, 380, 379, 134, 452

[56] References Cited

U.S. PATENT DOCUMENTS

| | | | |
|---|---|---|---|
| 943,133 | 12/1909 | Assmann | 292/169.14 |
| 1,387,888 | 8/1921 | Holt | 292/169.14 |
| 3,792,884 | 2/1974 | Tutikawa | 292/179 X |
| 4,236,396 | 12/1980 | Surko, Jr. et al. | 292/357 |

*Primary Examiner*—Richard E. Moore
*Attorney, Agent, or Firm*—Lothrop & West

[57] ABSTRACT

A lockset for use on any one of various door panels of different thickness and hinged on a door frame includes a latchbolt adapted to project into a holder on the door frame and to retract therefrom. Inner and outer knobs are rotatably mounted on opposite sides of the door panel to rotate about a common axis and relative to inner and outer escutcheons held against the panel of whatever thickness. Inner and outer spindles are engaged by the knobs and turn in the escutcheons. The spindles rotate a rectangular tube interengaged with the latchbolt for all axial positions of the knobs to provide retraction thereof. A push button in the inner knob, when latched in a depressed position, secures the outer knob against rotation by a nonrotatable engagement with the inner escutcheon. Rotation of the inner knob releases the push button from the depressed position and frees the outer knob for rotation. An aperture in the outer knob allows insertion of an emergency tool to release the push button from the depressed position.

26 Claims, 15 Drawing Figures

~3~
102
86
107
106
104
14
177
131
134
134
88
136
136
87
126
28
52
89
21
26
7
153
13
16
11
18
19
17
127
82
66
61
64
6
69
72
68
67
65
71
46
51
62
8
56
22
22
26
57
28
173
34
34
36
36
59
171
31
33
168
167
~3~

LOCKSET FOR A DOOR PANEL

CROSS-REFERENCES TO RELATED APPLICATIONS

A somewhat similar structure is shown in co-pending application Ser. No. 319,581 filed Nov. 9, 1981 in the names of Paul F. Hale and James R. Allison and assigned to the assignee of the present invention.

BRIEF SUMMARY OF THE INVENTION

The lockset is for a hinged door panel having outer and inner faces with a main bore extending between said faces along a main axis and an edge bore extending along a cross-axis and opening into said main bore. The lockset has an inner escutcheon spanning the main bore with an inner rotatable spindle passing through the inner escutcheon and into the main bore. There is an inner knob on the inner spindle. A latchbolt mechanism in the edge bore is connected to the inner spindle. An outer escutcheon spans the main bore with an outer rotatable spindle passing through the outer escutcheon and carrying an outer knob. The outer spindle is in the main bore with a connection to the inner spindle and with means for centralizing the knob mechanism. A button in the inner knob is movable to prevent and permit spindle rotation by controlling engagement between the inner escutcheon and the inner spindle.

DETAILED DESCRIPTION

Figure 1:
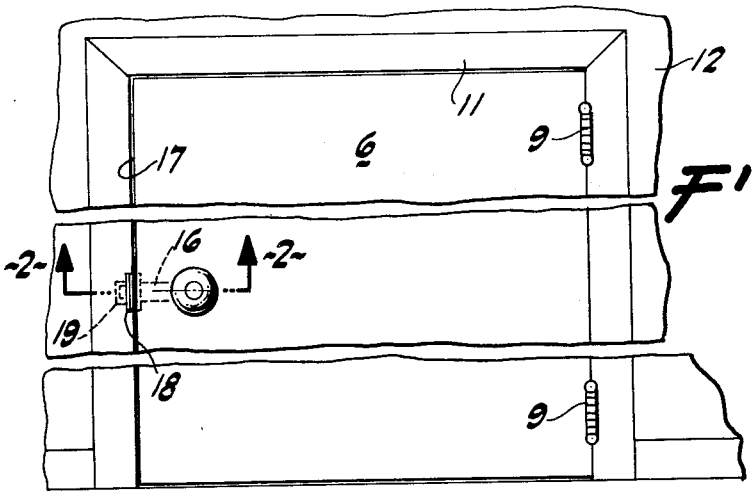
FIG. 1 is an elevation with portions being broken away of a door panel and surrounding wall with the lockset of the invention installed on the door panel.

A representative installation of the lockset of the invention is made in a door panel 6 having an inside surface 7 and an outside surface 8. The door panel is mounted on hinges 9 to swing within a door frame 11 in a wall 12. The door panel has a through or cross bore or main bore 13 of a generally circular cylindrical nature symmetrical about a transverse main axis 14. The main bore is intersected at right angles by an auxiliary or edge bore 16 extending along a cross-axis and also of generally circular cylindrical configuration. The edge bore extends inwardly from the edge 17 of the door panel 6 to intersect the cross bore near the center thereof. In the door frame 11 there is installed a strike plate 18 encompassing an inset strike chamber 19.

The main, door portion of the lockset incorporates an inside escutcheon 21 concentric with the axis 14 as well as a coaxial outside escutcheon 22. The escutcheons are generally frusto-conical in configuration and are urged against the faces 7 and 8 of the door panel by bolt fasteners 23 extending through the inside escutcheon 21 and having threaded engagement with columns 24 extending in an axial direction from the outside escutcheon 22. With this arrangement, the escutcheons 21 and 22 can be disposed at different axial distances from each other to accommodate door panels of a wide range of thicknesses.

Preferably the escutcheons are both provided with finish caps 26 with inturned rims to secure them in place. The caps 26 are of a decorative metal, partly for the purposes of trim. The escutcheons 21 and 22 can be made of relatively prosaic material and can be afforded a variety of pleasing exterior appearances by the trim. In addition, the trim caps 26 have flanges 27 (FIG. 3) to serve to position washers 28 between the escutcheons themselves and the trim.

A circular cylindrical outer spindle 31, preferably fabricated of a rolled strip, is disposed to be coaxial with the axis 14 and is journalled in the outer escutcheon 22 for rotation about the axis 14. The spindle 31 at its outer end is shrouded by the hub 32 of an outer knob 33, preferably of material matching the trim 26, and secured to the outer spindle for rotation unitarily therewith and against axial motion by detents 34 (FIG. 2) depressed into open-ended and closed-ended slots 36 in the wall of the outer spindle, so that the outer knob and the outer spindle in effect form one rotary unit.

Figure 10:
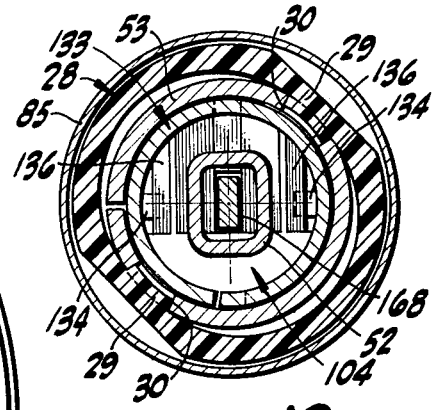
FIG. 10 is a cross-section, the plane of which is indicated by the line 10—10 of FIG. 5.

As especially shown in FIG. 10, the washer 28 is deformable and when relaxed as shown is ovoid in plan and fits within the trim 26 and against the end of the adjacent outer escutcheon 22 for axial confinement. Projecting inwardly of the washer 28 are opposite lugs 29 adapted to lie within openings 30 in the outer spindle 31. Thus, relative axial motion between the outer escutcheon 22 and its trim 26 and the outer spindle 31 is precluded. When the arcuate opposite portions of the washer 28 are squeezed toward each other, that deformation causes radially outward motion of the lugs 29, the adjacent circumferential portions of the washer being flattened so that the lugs can move entirely out of the openings 30 and so mutually release the outer spindle 31 and the escutcheon 22. Both washers 28 act in the same way.

Figure 14:
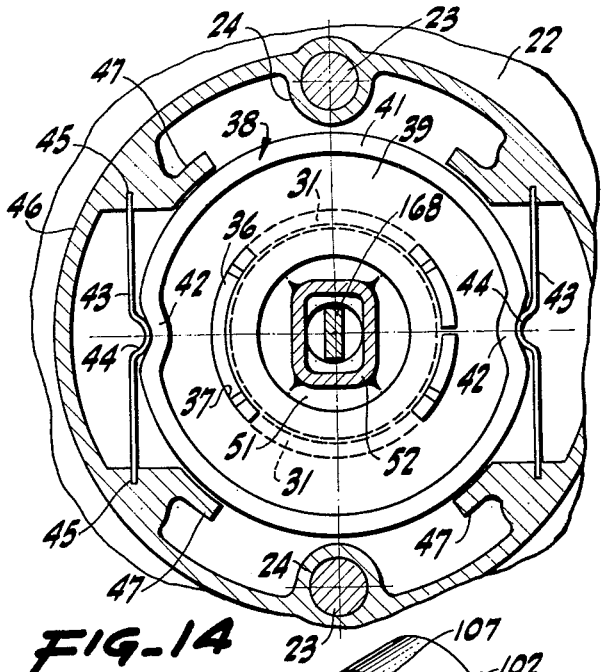
FIG. 14 is a cross-section, the plane of which is indicated by the line 14—14 of FIG. 3.

Adjacent its inner end, the outer spindle 31 has an interrupted end rim 35 (FIG. 3) passing axially through appropriate receiving arcuate slots 37 (FIG. 14) in a centralizing cup 38. The cup has a planar, washer-like plate 39 (FIG. 3) resting against the exposed end of the outer spindle 31 and also has a flange 41 or rim. The flange 41 is generally circular cylindrical in configuration except for a pair of flange indentations 42 (FIG. 14). A pair of leaf springs 43 have central protuberances 44 thereon adapted to rest in and cooperate with the indentations as locating or centralizing devices. The springs are seated in notches 45 in adjacent portions of a cylindrical wall 46 extending from the outer escutcheon 22 and merging with the columns 24.

The flange 41 is loosely confined between arcuate extensions 47 (FIG. 14) from the inner wall 46. This arrangement affords a good peripheral, loose confinement for the radial position of the outer spindle 31. Furthermore, rotation of the outer spindle about the axis 14 is free except that the spring parts 44 cooperate with the indentations 42 and tend normally to hold the spindle in selected rotated positions and subject to dislodgment therefrom by a slightly superior force.

Figure 3:
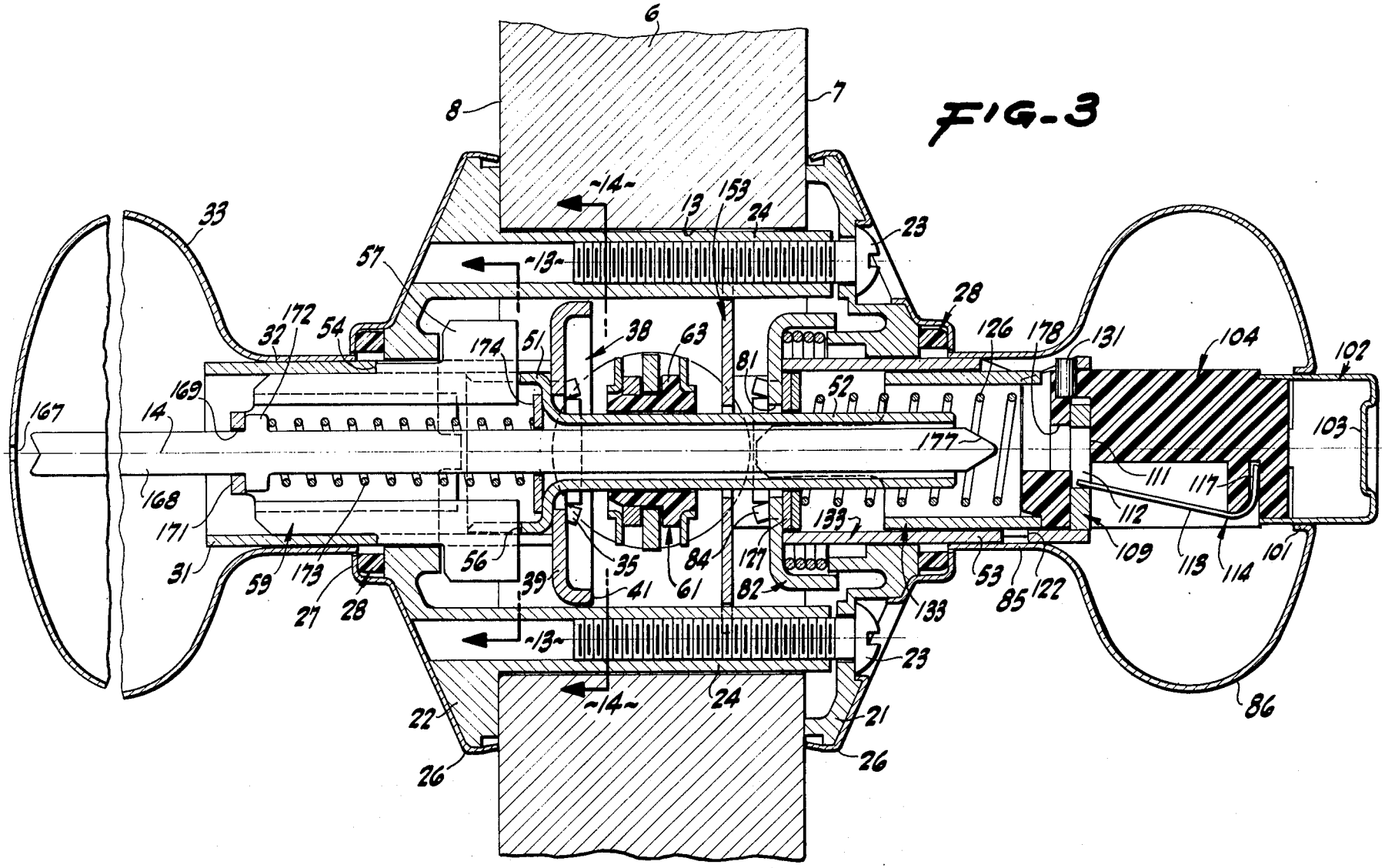
FIG. 3 is a cross-section similar to FIG. 2, but taken in a plane at right angles to the plane of FIG. 2.

Within the outer spindle 31 and near the inner cup 38 thereon and abutting the outside face of the plate 39 is a cylindrical, hollow hub 51 (FIG. 3). This has a generally circular configuration at the end of and merging with a rotational, connecting tube 52 itself having a generally rectangular cross-section. The tube 52 extends along the axis 14 from the outer spindle 31 and well into an inner spindle 53.

Figure 13:
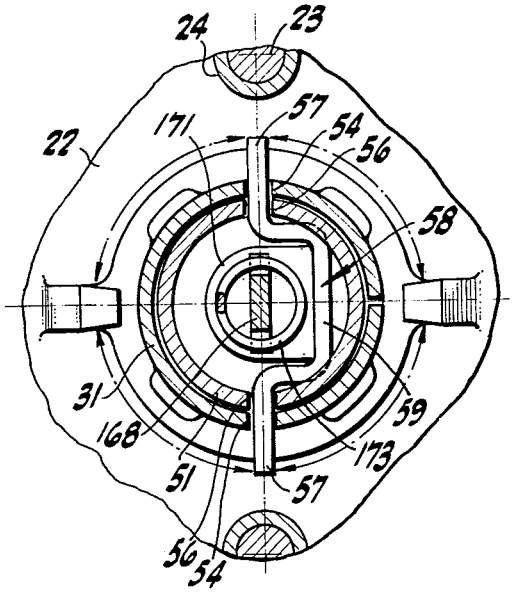
FIG. 13 is a cross-section, the plane of which is indicated by the line 13—13 of FIG. 3.

The tube 52 and the outer spindle are interrelated for conjoint rotation about the axis 14. For this reason, the outer spindle 31 is provided with axially extending, radial slots 54 (FIGS. 3 and 13) and the hub 51 is also provided with registering, axially extending slots 56. Extending through both slots are wings 57 (FIG. 13) on a driver plate 58 having a connecting portion 59. In this fashion the driver plate 58 is accurately positioned within the outside spindle 31. The wings 57 thereon by going through the axially extending, radial slots 56 and 54 in the concentric outer spindle 31 and hub 51 secure those parts for rotation in unison, although permitting ready axial assembly and disassembly thereof. Thus, when the outer knob 33 is rotated, the outer spindle is similarly rotated and causes rotation of the connecting tube 52.

Figure 2:
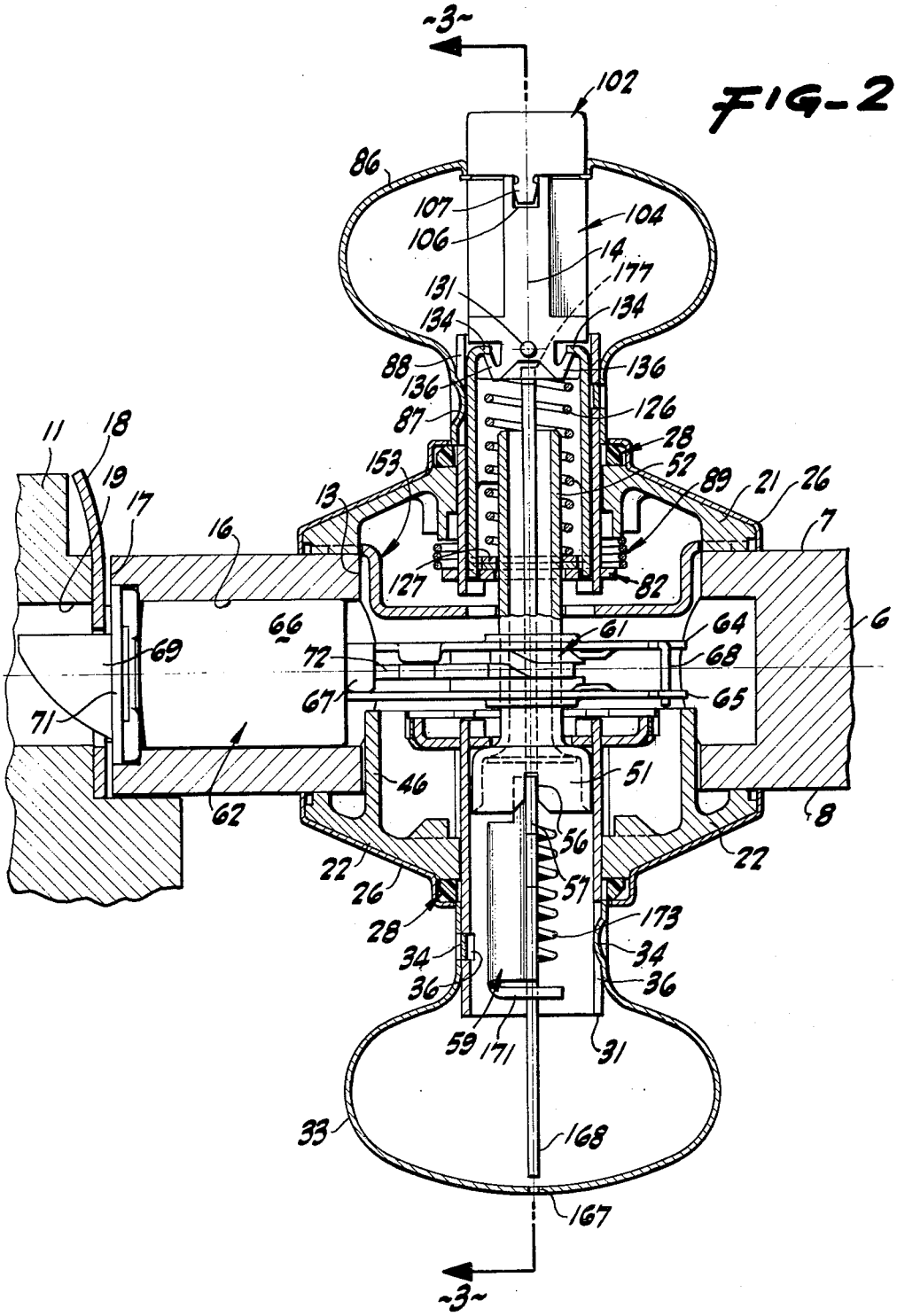
FIG. 2 is a cross-section, the plane of which is indicated by the line 2—2 of FIG. 1.

The rectangular tube 52 intermediate its ends passes through the rectangularly apertured hub 61 of a latchbolt mechanism generally designated 62 (FIG. 2). The hub 63 (FIG. 3) has at least one circular cylindrical portion designed to be centered in and rotate within at least one of a pair of side plates 64 and 65 (FIG. 2) fastened to a latchbolt housing 66. The side plates are approximately positioned with respect to each other by tabs 67 and 68 (FIG. 4) appropriately interrelated and fastened. The side plates 64 and 65 are joined to the circular cylindrical housing 66 by transversely directed hooks at one end, as disclosed in the co-pending application, above noted.

Reciprocable within the housing 66 is a spring-pressed latchbolt 69 of the customary kind passing through a face plate 71 designed to be secured by appropriate fasteners in the edge of the door panel 6. The latchbolt is arranged to cam against the strike plate 18 when the door panel is moved toward closed position. When retracted, the latchbolt 69 permits the door panel to swing open with respect to the door frame.

The latchbolt 69, as shown in the above-identified application, has an extended central plate 72 (FIGS. 2 and 4) with upper and lower offset lugs 73 adapted to be engaged by upper and lower, offset side cams 74 on the hub 61. As is customary, the latchbolt 69 is urged toward its projected position by a spring (not shown) within the housing 66. With this arrangement, when the outer knob spindle 31 is rotated, the rectangular tube 52 is likewise rotated and rotates the hub 61 so that, depending upon the direction of rotation, either one or the other of the side cams 74 interengages with the appropriate one of the side lugs 73 on the central plate 72 of the latchbolt and causes the latchbolt 69 to retract. Turning the outer knob, for example, causes the latchbolt to compress its spring and to be withdrawn so that the door panel can be opened. When that knob is released, the spring in the latchbolt mechanism causes projection of the latchbolt again and allows restoration of the outer knob to its original position, the knob being well centralized by the leaf springs 43 and attendant mechanism.

Figure 5:
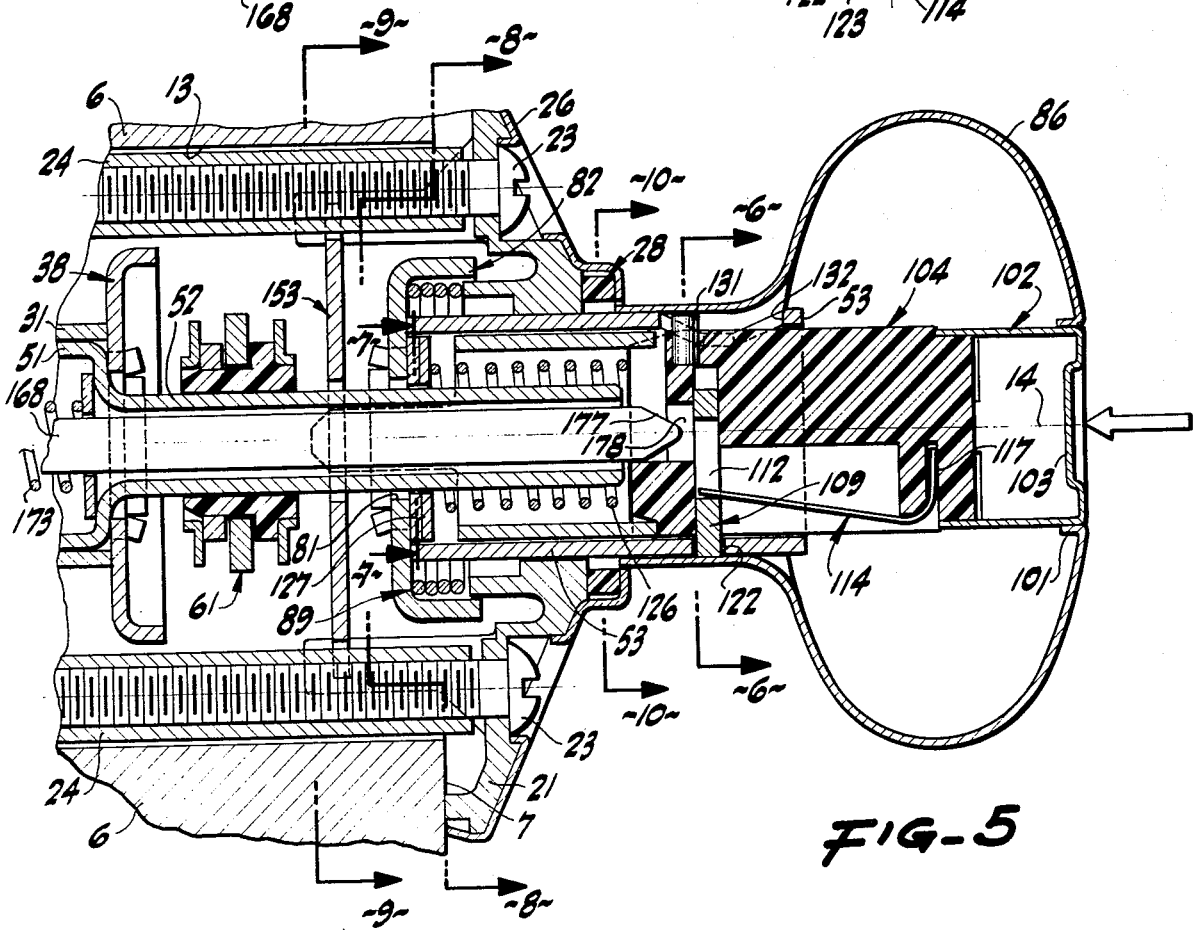
FIG. 5 is a cross-section like FIG. 3 but with the lockset in locked condition, the plane of section being indicated by the line 3—3 of FIG. 2.

The rectangular tube 52 extends axially through a central circular opening 81 (FIG. 5) in a centralizing member 82 at the end of the inner spindle 53. This spindle is extended sufficiently to afford a firm support for the hub 85 (FIG. 3) of an inner operator knob 86 comparable to the outer knob 33 and secured in place with respect to the spindle by indentations 87 (FIG. 2) deformed into slots 88 near the end of the spindle. These interlocks preclude relative rotation of the knob and spindle. The end of the inner spindle extends against the centralizing member 82 and has tongues 84 passing through appropriate curved slots 83 in the member 82 and split and spread to hold the parts for concurrent rotation and against axial displacement.

Figure 11:
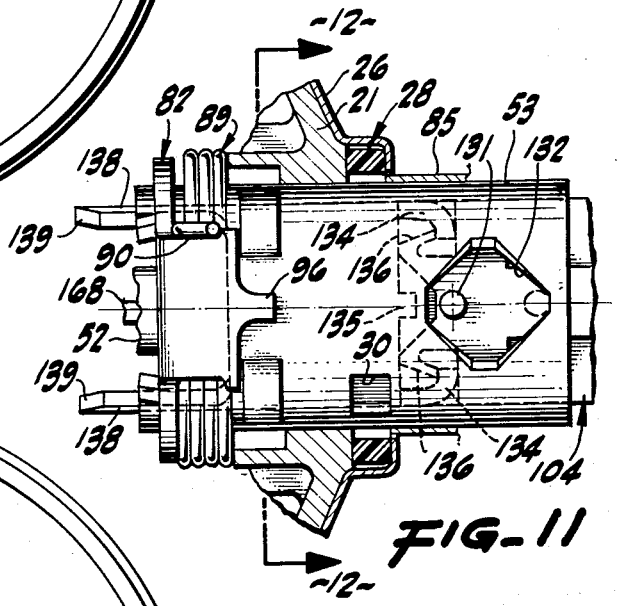
FIG. 11 is a view comparable to the upper portion of FIG. 4.

A centralizing helical spring 89 (FIGS. 4, 8 and 11) extends around the inner spindle and has one projecting end 90 designed to abut one of the extensions 47 outstanding from the inner escutcheon 21. The other end 91 of the spring 89 is designed in one position to abut another of the extensions 47 of the escutcheon 21.

Acting against the spring ends 90 and 91 are panels 92 (FIG. 4) extending axially from opposite sides of the centralizing member 82. Thus, when the inner knob 86 is rotated in either direction, the corresponding spring end 90 or 91 is moved by the adjacent panel 92 to rotate clockwise or counterclockwise (in FIG. 8), and the remaining spring end 90 or 91 is urged even more strongly against the adjacent one of the columns 47 so that the spring 89 is further tensioned. When the knob 86 is released, the tensioned spring returns the parts to their normal rest position with the knob centralized.

There has thus been provided a latchbolt operating mechanism effective by rotation of either an inner knob or an outer knob to afford a door panel release action by inside operation or outside operation of the latchbolt.

Figure 15:
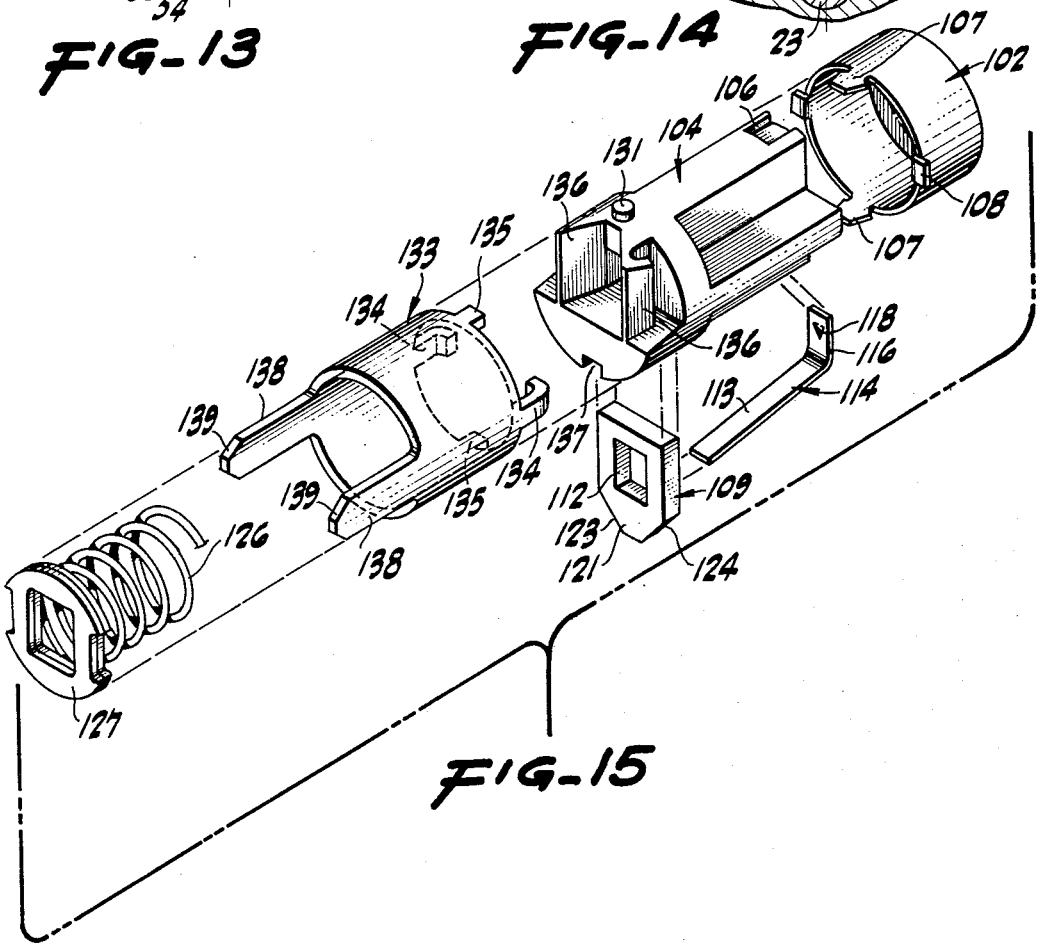
FIG. 15 is an exploded view in isometric perspective showing portions of the latch button mechanism in their proper axial locations.

In addition to the means for inner knob and outer knob operation of the latchbolt, there are afforded means for securing the knobs against rotation under certain circumstances and for releasing the knob mechanism for free rotation under other circumstances. For that reason, the inner knob 86 in its central portion has an inturned flange 101 (FIG. 5) serving partially to centralize and position a push button 102 with a reenforcing indentation 103 therein. The push button is united with a plug 104 arranged to extend along the axis 14. The outermost end of the plug has opposite notches 106 (FIG. 15) therein for frictionally receiving projections 107 on the inner rim of the button. There are outturned stops 108 on the button for limiting the axial movement thereof.

Projecting radially near the inner end of the plug is a transversely extending slide 109 (FIGS. 3 and 15) confined in a transverse slot 111 in the plug. The slide has an opening 112 therethrough to receive the active end 113 of a leaf spring 114 having a bent end 116 receivable in a cross slot 117 in the plug. The spring is generally retained in that position by a tang 118 outstruck therefrom and frictionally engaging the wall of the slot 117. The spring 114 tends to move the slide 109 radially outwardly of the plug so that the bevelled end 121 of the slide may be readily received in a peripheral slot 122 (FIG. 5) in the inner spindle. By this means, when the push button 102 is moved manually in an axially inward direction, it moves the plug 104 with it until the spring 114 urges the slide 109 to engage with the notch 122 in the inner spindle 53. By these means the plug is axially retained in its inner position.

Figure 6:
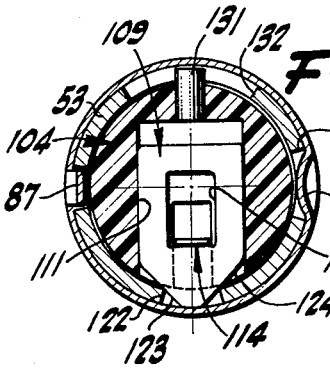
FIG. 6 is a cross-section, the plane of which is indicated by the line 6—6 of FIG. 5.

Upon rotation of the inner knob 86 and spindle 53 in either direction from its median or central position, there is relative inner spindle rotation with respect to the plug 104 so that the edges of the spindle slot 122 (FIG. 6) cam against the inclined faces 123 or 124 of the slide 109 and urge the slide back into the securing slot 111 against the urgency of the spring 114. Under those circumstances the plug 104 is restored to its axially outermost position by a spring 126 (FIG. 3) bearing against the inner end of the plug 104 and also bearing against a pair of washers 127 disposed against the centralizing member 82. The relative rotary and axial movements of the plug and of the spindle are confined somewhat by a pin 131 (FIGS. 5, 11 and 15) operating between the converging side edges of an approximately diamond-shaped aperture 132 (FIG. 11) in the inner spindle 53.

The rotary and axial movement of the plug 104 is shared by a connector sleeve 133 (FIG. 15) having at one end inturned tangs 134 and also having axially extending lugs 135. When the plug and sleeve are placed axially together, the tangs 134 ride over the inclined faces of cam walls 136 on the plug 104. When the parts are in assembled position, the tangs 134 move together and are disposed behind and interlock with the walls 136. At the same time, one of the lugs 135 in symmetrical location finds its way into a slot 137 in the end of the plug 104. Not only are the parts held together in an axial location, but they also are constrained against relative rotary motion.

Figure 7:
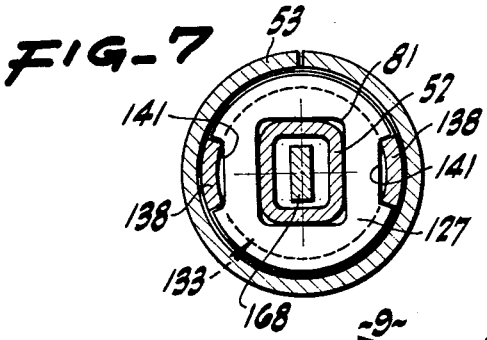
FIG. 7 is a cross-section, the plane of which is indicated by the line 7—7 of FIG. 5.
Figure 4:
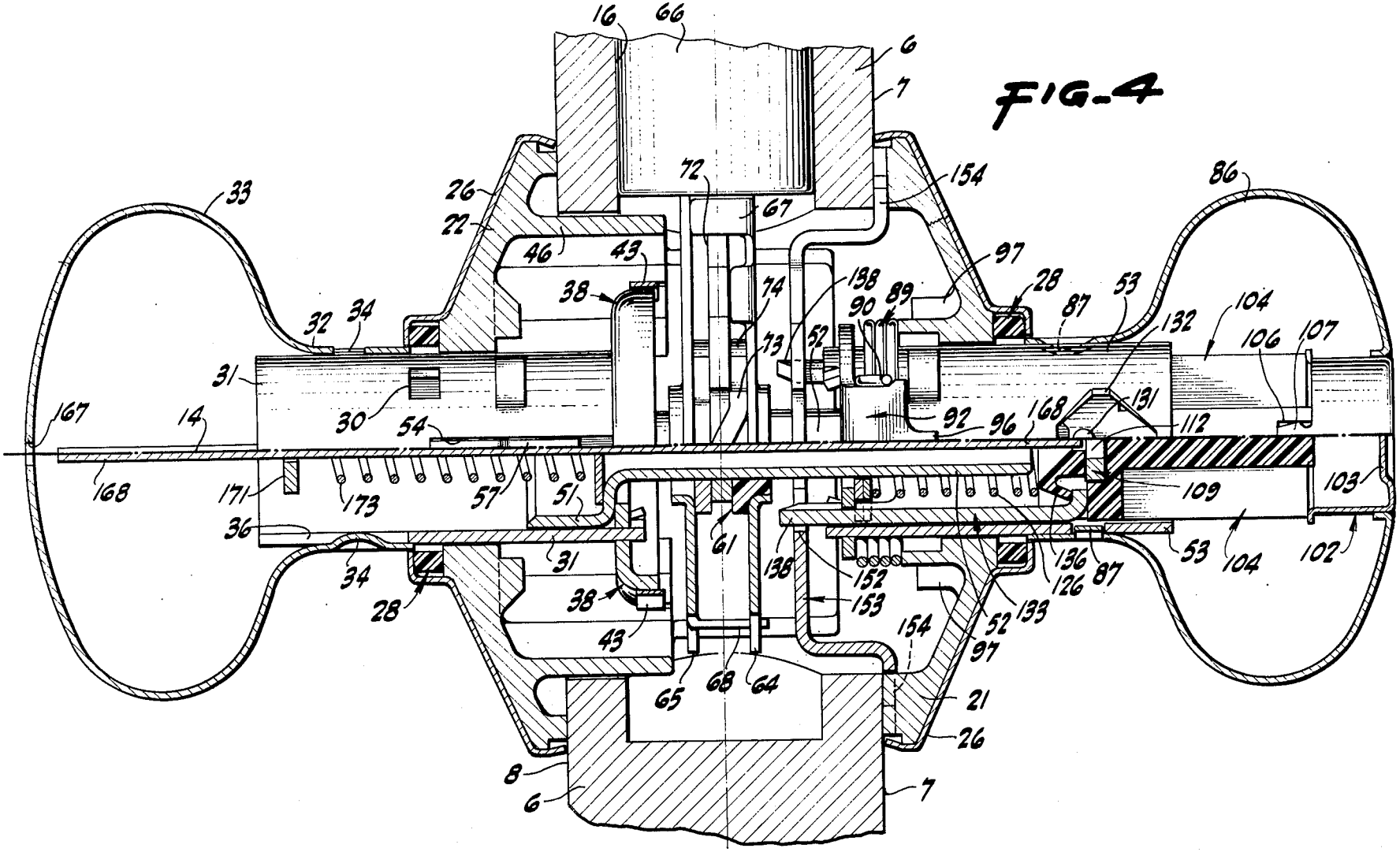
FIG. 4 is a view similar to FIG. 2 on the right-hand half, and on the left-hand half shows structure comparable to that shown in FIG. 3, but largely in elevation and with the lockset in a locked condition rather than an unlocked condition.
Figure 8:
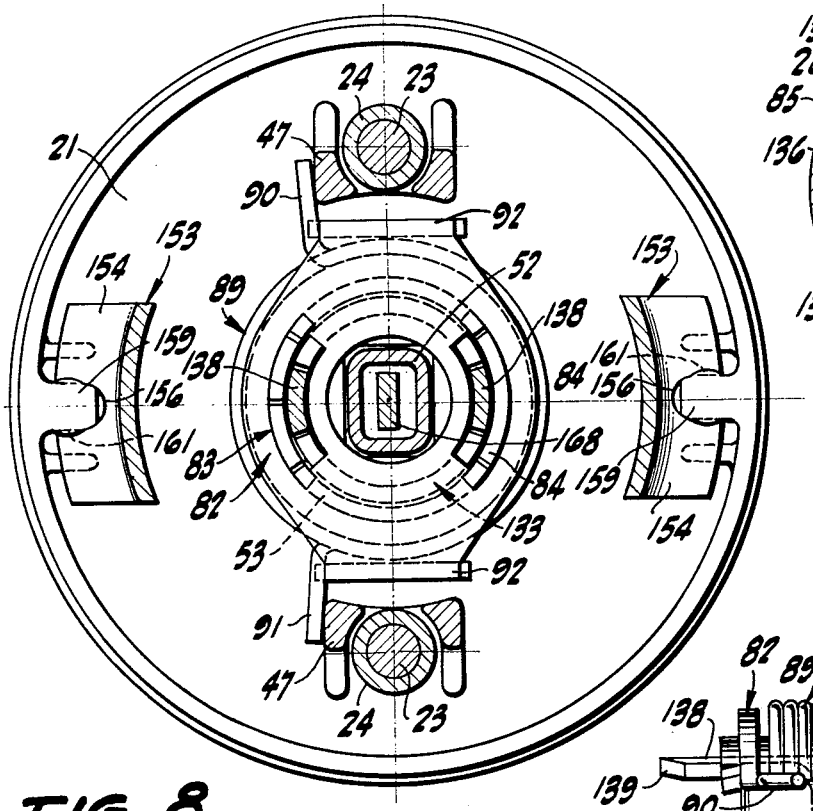
FIG. 8 is a cross-section, the plane of which is indicated by the line 8—8 of FIG. 5.
Figure 9:
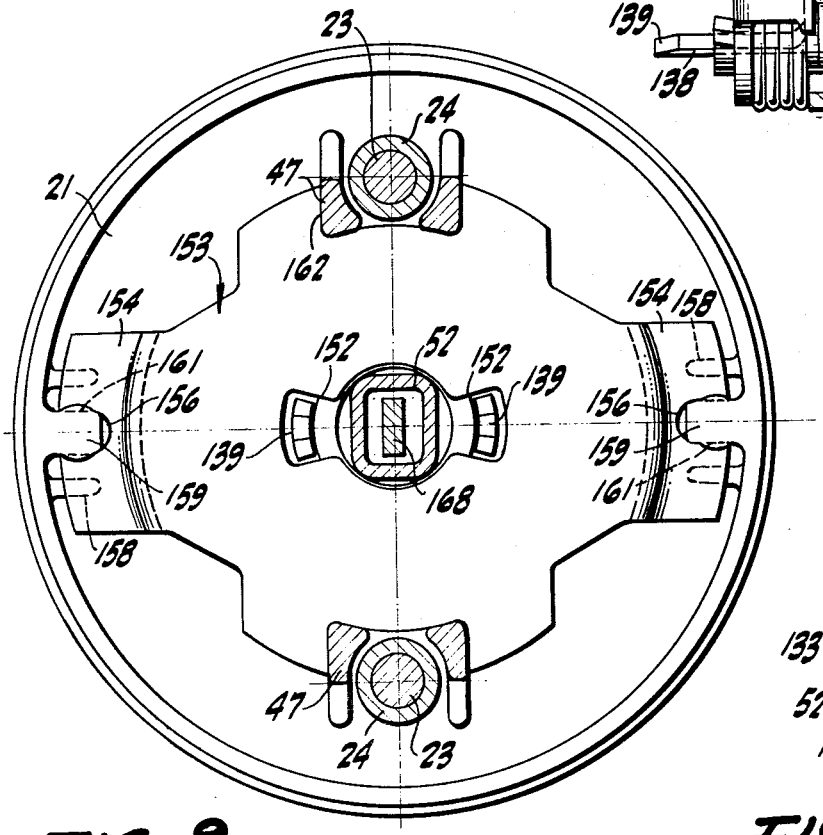
FIG. 9 is a cross-section, the plane of which is indicated by the line 9—9 of FIG. 5.
Figure 12:
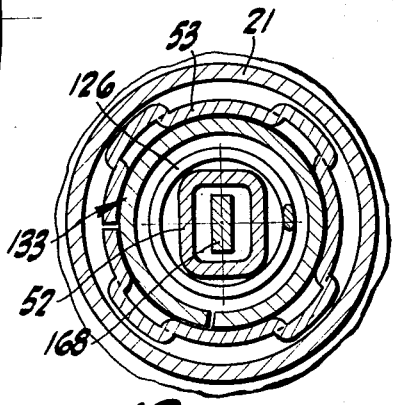
FIG. 12 is a cross-section, the plane of which is indicated by the line 12—12 of FIG. 11.

The sleeve 133 follows the movement of the plug 104. Moving as part of the sleeve are a couple of axially extending tangs 138 or tines lying inside the spring 89 (FIGS. 4, 7 and 8). The tangs have bevelled ends 139 (FIGS. 7 and 4) designed to enter into and interlock with peripheral notches 141 (FIG. 7) in the washer pair 127. Also, in an innermost position, the tangs enter into and are disposed with the tang ends 139 lying in a cross slot 152 or perforation in a bridge plate 153 (FIGS. 4 and 9). The bridge plate 153 has a central portion dipping into the interior of the cross bore in the door panel and has end portions 154 near the inside face 7 of the door panel 6. There are radial slots 156 in the end portions 154. The end portions are designed to rest against supporting ribs 158 on the inner face of the inside escutcheon. Each slot 156 is designed to receive the staked end 159 of an inwardly directed lug 161 on the inner escutcheon. Thus, the lugs 161 and the bridge plate are firmly interlocked to preclude any relative motion therebetween. The bridge plate 153 also has cut-outs 162 interfitting with the extensions 47 encompassing the columns 24 so that the bridge plate 153 is further anchored against any rotation relative to the inner escutcheon 21.

When the button 102 is depressed and its associated structure is translated toward the interior of the lock in an axial direction, the bevelled ends 139 of the tangs 138 advance through the notches 141 (FIG. 7) and into the cross slot 152 (FIG. 9) in the bridge plate 153 and so preclude free relative rotation between or interlock the inner spindle, inner knob and the inner escutcheon. Also, rotation of the outer knob 33 is itself precluded inasmuch as the rectangular tube 52 is secured against rotation relative to the washer 127 nonrotatably engaged with the now-immovable inner spindle 53. In this fashion, when the button 102 is pushed inwardly and is latched in position, the outer knob is locked and rotation thereof and exterior withdrawal of the latchbolt are precluded. Even so, the interior knob remains manually rotatable, as the inner spindle can always be turned with respect to the sleeve 133 and the tangs 138.

Whenever the inner knob is rotated, the slide 109 is withdrawn from the slot 122 and the spring 126 is effective to translate the plug 104 and the sleeve 133 toward the undepressed position, thus withdrawing the tangs 138 from the slots 152 in the bridge plate 153. Rotation of the outer knob and spindle and consequently of the rectangular tube 52 is then possible and the latchbolt 62 can be withdrawn. Thus, by rotating the inner knob, the lockset is changed from its locked condition to its unlocked condition with both knobs freely rotatable for ready retraction of the latchbolt 69 and ready for relocking. This is the normal functioning of the apparatus and in many instances is sufficient.

Sometimes, however, there are occasions when emergency unlocking or access is desirable for unlocking from the outside. For that reason, the outer knob 33 is provided with a relatively small, central aperture 167 (FIGS. 2 and 3) through which may be introduced a wire end, a nail, or comparable object to abut against the end of a release bar 168 extending axially and slidably through an opening 169 in the offset end 171 of the connecting portion 59. Normally urged against the end 171 is a cross bar 172 integral with the release bar 168. The offset end 171 and the connecting portion 59 are urged into position by a coil spring 173 surrounding the bar 168 and abutting a washer 174 lying against the inturned, cup-like end portion 51 of the rectangular tube 52. The release bar 168 extends into and entirely through the rectangular tube 52 and has a bevelled end 177 extending therefrom.

The end 177 normally is in a retracted position under urgency of the spring 173, as shown in FIG. 3, but upon imposition of an inward axial force by an abutting tool extending through the opening 167, the release bar 168 is translated inwardly (toward the right in FIGS. 3 and 4), thus compressing the spring 173 and moving the bevelled end 177 (FIG. 5) through an axial opening 178 in the inner end of the plug 104. The end 177 is then effective to cam against an edge of the opening 112 in the slide 109. The detent slide 109 is correspondingly moved transversely, cocking the spring 114 and lifting the bevelled end 21 of the slide out of the slot in the inner spindle .The spring 2 is then free and effective to translate the entire plug 0 and its accompanying parts to the right in IG.5 not only projecting the button but also unlocking or releasing the plug so thatretraction of the latchbolt 69 by rotation of the outer knob 33.

When the special actuation tool such as a rod or nail is removed from the opening 167, the spring 173 is effective to restore the central release bar 168 to its outermost, original position. The lockset is then again available for the kinds of operation previously described.

In this fashion there has been provided a relatively simple, straightforward lockset for actuating a latchbolt and arranged so that the mechanism can be rotated by either an inner knob or an outer knob and so that the mechanism can be locked against outer knob rotation by a structure which is directly connected with the inside escutcheon. The inner and outer knobs are interconnected by sliding interengagements, so that the device can be installed properly on door panels of varying thicknesses. There is ready release of the locked engagement by rotation of the inner knob, and there is also emergency release of the lock mechanism by the use of a special tool operating through an aperture in the outer knob.

We claim:

1. A lockset adapted to be mounted on a door panel having an outer surface and an inner surface and having a main bore extending between said outer surface and said inner surface along a main axis and said door panel also having an edge bore extending along a cross-axis and opening into said main bore, comprising an inner escutcheon adapted to be disposed against said inner surface in a position spanning said main bore, an inner spindle rotatably mounted in and passing through said inner escutcheon, an inner operator on said inner spindle, a latchbolt mechanism adapted to be disposed in said edge bore, means connecting said latchbolt mechanism and said inner spindle, a bridge plate having a central portion adapted to extend axially into said main bore, means for securing said bridge plate to said inner escutcheon against rotation relative thereto, a sleeve guided by and nonrotatably connected to said inner spindle, and means for moving said sleeve along said main axis into and out of nonrotatable engagement with said bridge plate.

2. A device as in claim 1 in which said sleeve guided by said inner spindle includes a push button projecting along said main axis through said inner operator.

3. A device as in said claim 2 in which said push button and said inner spindle are both relatively rotatable about said main axis.

4. A device as in claim 1 in which said bridge plate has a perforation asymmetrical with respect to said main axis and said sleeve includes an axially extending tine movable into and out of said perforation.

5. A device as in claim 4 including a spring for urging said tine out of said perforation.

6. A device as in claim 5 including means defining a slot in said inner spindle, and a transverse slide on said push button movable into said slot for holding said tine in said perforation.

7. A device as in claim 6 including a spring for urging said transverse slide into said slot.

8. A device as in claim 6 in which said transverse slide has a beveled corner adapted to cam against said inner spindle at the edge of said slot and urge said transverse slide out of said slot upon relative rotations of said inner spindle and said push button about said main axis.

9. A device as in claim 1 in which said means guided by said inner spindle is also rotatable relative thereto about said main axis.

10. A device as in claim 9 in which said inner spindle has a wall with an aperture having converging side edges, and a pin on said push button adapted to abut and be guided by said edges.

11. A device as in claim 1 including a helical spring surrounding said inner spindle and having ends projecting in directions having a component radial with respect to said axis, means rotatable with said inner spindle about said axis and adapted to engage one of said ends, and means on said inner escutcheon adapted to be engaged by the other of said ends.

12. A device as in claim 11 in which said rotatable means engages said one of said ends in only one direction of rotation of said spindle about said axis and in which said other of said ends engages said means on said inner escutcheon in said one direction of rotation.

13. A device as in claim 1 including a noncircular tube extending along said axis, and a disc having a nonrotatable peripheral engagement with said inner spindle and a nonrotatable central engagement with said noncircular tube.

14. A device as in claim 13 in which said latchbolt mechanism includes a rotary actuator having a noncircular aperture therein adapted nonrotatably to receive said noncircular tube.

15. A lockset adapted to be mounted on a door panel having outer and inner surfaces, having a main bore extending between said surfaces along a main axis and having an edge bore extending along a cross-axis and opening into said main bore comprising a latchbolt structure adapted to be disposed in said edge bore, an outer escutcheon adapted to span said main bore, a cylindrical wall on said outer escutcheon adapted to extend into said main bore in substantial contact with said panel, columns incorporated with said cylindrical wall and adapted to receive bolt fasteners passing through said inner escutcheon and located within said main bore, an outer spindle passing through said outer escutcheon and adapted to extend into said main bore, an outer operator on said outer spindle, means defining an interrupted rim on the inner end of said outer spindle, a plate overlying the inner end of said outer spindle and having slots receiving said interrupted rim, a noncircular tube extending along said main axis adapted to engage said latchbolt structure and having a hub at one end disposed within said outer spindle, means for urging said hub against said plate, and means for preventing relative rotation of said hub and said outer spindle about said main axis.

16. A lockset as in claim 15 in which said hub has a cross slot defining walls therein, and means engaging said outer spindle and engaging said walls of said cross slot for concurrent rotation of said spindle and said hub about said main axis.

17. A lockset as in claim 16 in which a portion of said engaging means is disposed to move axially and to bear upon said outer spindle.

18. A lockset as in claim 17 including a spring for urging said engaging means into abutment with said outer spindle.

19. A lockset for a door panel having outer and inner surfaces and a main bore extending through said panel between said surfaces and having an edge bore intersecting said main bore comprising an inner escutcheon, an outer escutcheon, means for pressing said escutcheons against said surfaces, means on said inner escutcheon spanning said main bore, an inner spindle mounted for rotation in said inner escutcheon, an inner knob on said inner spindle, means movable into and out of engagement with said spanning means for releasably holding said inner spindle against said rotation in said inner escutcheon, means in said inner spindle for operating said holding means, an outer spindle mounted for rotation in said outer escutcheon, an outer knob on said outer spindle, and means for connecting said inner spindle and said outer spindle for conjoint operation.

20. A lockset comprising an inner escutcheon, an outer escutcheon, means for urging said escutcheons toward each other, an inner spindle mounted for rotation in said inner escutcheon, means providing a notch fixed with respect to said inner escutcheon, detent means mounted on said inner escutcheon against rotation relative thereto, and means for moving said detent means toward said outer escutcheon into engagement with said notch and away from said outer escutcheon out of engagement with said notch.

21. A lockset as in claim 20 including means for constraining said detent moving means to move axially within said inner spindle.

22. A lockset as in claim 20 including an outer spindle rotatable in said outer escutcheon, and means for interconnecting said outer spindle and said inner spindle against rotation relative to said inner escutcheon.

23. A lockset as in claim 20 in which said detent moving means includes a spring for urging said detent out of engagement with said notch.

24. A lockset as in claim 23 including means for latching said detent in engagement with said notch.

25. A lockset as in claim 24 including means for unlatching said latching means by rotation of said inner spindle.

26. A lockset comprising an inner escutcheon, an outer escutcheon, means for positioning said escutcheons in various axial positions with respect to each other, an inner spindle mounted for rotation in said inner escutcheon and against axial motion relative thereto, an outer spindle mounted for rotation in said outer escutcheon and against axial motion relative thereto, a tube interconnecting said outer spindle and said inner spindle for rotation in unison in all of said axial positions of said escutcheons, a latchbolt, means engaging said tube in all of said axial positions of said escutcheons for actuating said latchbolt, means on and extending from said inner escutcheon and nonrotable relative thereto, means movable into and out of a position for holding said tube against rotation relative to said extending means, a release bar extending at least partially within said tube for moving said movable means out of said holding position, and a spring for urging said release bar toward said outer escutcheon.

* * * * *